US005794678A

United States Patent [19]

Beringer et al.

[11] Patent Number: 5,794,678

[45] Date of Patent: Aug. 18, 1998

[54] SEALING SYSTEM FOR A ROLLER DOOR

[75] Inventors: Mark D. Beringer, Sherril; David P. Leppert, Zwingle, both of Iowa

[73] Assignee: Rite-Hite Corporation, Milwaukee, Wis.

[21] Appl. No.: 604,905

[22] Filed: Feb. 22, 1996

[51] Int. Cl.[6] ..... E06B 7/16

[52] U.S. Cl. ..... 160/41; 160/271; 160/273.1; 160/268.1

[58] Field of Search ..... 160/11, 41, 271, 160/272, 273.1, 209, 268.1, 269

[56] References Cited

U.S. PATENT DOCUMENTS

| | | | |
|---|---|---|---|
| 881,196 | 3/1908 | McCall | 160/41 |
| 1,226,881 | 5/1917 | Hayton | 160/41 |
| 2,247,306 | 6/1941 | Partridge | 160/41 |
| 4,357,978 | 11/1982 | Keller et al. | 160/41 |
| 4,651,796 | 3/1987 | Gardner et al. | 160/266 |
| 4,884,617 | 12/1989 | Coenraets | 160/271 |
| 5,520,236 | 5/1996 | Thomas et al. | 160/120 |
| 5,542,463 | 8/1996 | Pinkalla et al. | 160/273.1 |

FOREIGN PATENT DOCUMENTS

| | | | |
|---|---|---|---|
| 497270 | 9/1919 | France | 160/41 |
| 3035614 | 5/1982 | Germany | 160/269 |
| 2047782 | 12/1980 | United Kingdom | 160/41 |

*Primary Examiner*—Kenneth J. Dorner
*Assistant Examiner*—Bruce A. Lev
*Attorney, Agent, or Firm*—Leydig, Voit & Mayer, Ltd.

[57] ABSTRACT

A roller door sealing system including at least one sealing member carried on the curtain, and disposed adjacent the end of the curtain attached to the roller, and a seal engaging member supported adjacent the curtain. The sealing member and the seal engaging member are disposed such that the sealing member engages the seal engaging member and seals the space between the curtain and the seal engaging member as the curtain approaches the doorway-blocking position. The sealing function provided by the sealing member or members only occurs as the door approaches the door blocking position.

11 Claims, 3 Drawing Sheets

SEALING SYSTEM FOR A ROLLER DOOR

FIELD OF THE INVENTION

The invention relates generally to industrial roller doors, and more particularly to a sealing assembly for a roller door.

BACKGROUND OF THE INVENTION

Roller doors are used in a variety of industrial applications, typically for the purpose of separating areas within a building, or closing off building entries from the outside. A typical roller door comprises a fabric curtain which is wound about a roller journalled for rotation adjacent to the doorway with which the roller door is associated. Typically, the roller is oriented horizontally, and is disposed slightly above the doorway, and spaced from the wall surrounding the doorway. Other roller doors have a vertically oriented roller such that the curtain moves sideways to cover the doorway. To close either type of roller door, the roller is rotated such that the curtain pays off of the roller, thus moving to a doorway blocking position. Of course, the spacing between the roller and adjacent wall increases as the curtain unwinds from the roller, since the combined diameter of the curtain/roller is reduced. The door is opened by reversing the direction of the roller and rolling the fabric curtain onto the roller. Such roller doors are typically powered opened and closed. Alternatively, roller doors with a horizontally disposed roller may be powered open and allowed to fall closed by gravity. Further still, spring or manual actuation may also be used.

Roller doors are often employed inside of warehouses or other buildings for the purpose of separating environmentally-controlled areas. For example, a roller door may be in place between refrigerated and unrefrigerated sections of a warehouse. Alternatively, a roller door may be employed over an external door to a warehouse or other facility, such as at a loading dock. In either case, the door must include means for maintaining separation between the two types of environments that may be present on either side of the door. Accordingly, roller doors often include seals for preventing the leakage of air, and in some cases light, past the door.

The seals typically used with roller doors rely on constant contact between the door curtain and the seal to prevent leakage. In one type of seal, a sealing member projects outwardly, either from the wall in which the doorway is disposed or from framing structure associated with the door, to frictionally engage the door and prevent leakage between the roller and the wall or the framing. The sealing member is typically either made of rubber, or is a brush or series of brushes extending the width of the door. The frictional engagement between the sealing member and the door, which gives the advantageous sealing function, also results in disadvantages.

For example, the constant frictional contact between the sealing member and the door can lead to undue wear—both of the sealing member and of the curtain fabric. As a result, the sealing member may need frequent replacement to avoid loss of sealing. While typical curtain fabric, such as HYPALON brand fabric, may not be adversely affected by the constant wear, roller doors often include a so-called "vision panel" of clear plastic or PVC to allow personnel to see through the door when it is in the doorway blocking position. The plastic vision panel may be scratched by the brushes forming the sealing member, or be otherwise obscured by the constant frictional contact with the sealing member. Any reduction in the transparent quality of the vision panel is undesirable.

The constant frictional engagement between the sealing member and the door may also negatively affect door actuation. The friction serves as an added drag on the moving curtain, which added drag must be compensated for. In the case of a door which is powered open and closed, the motor must work harder to compensate. In the case of a gravity-fall door, the friction needed for adequate sealing may prevent the gravity door from falling as desired. Accordingly, sealing efficiency may need to be compromised to ensure that the door will actuate properly. Alternatively, the motor or other power means may need to be overdesigned—adding expense to the door.

The drawbacks associated with such frictional seals may be exacerbated by the geometry of the roller door. The curtain winds onto the roller as it moves from its doorway blocking to the unblocking position. As a result, the diameter of the curtain/roller combination also increases. The frictional seal, however, is most desired when the curtain is unrolled (i.e.—when the curtain is in the doorway blocking position) and the curtain/roller diameter is at a minimum. Because of this, the frictional contact between the wound curtain and the sealing member is larger than would otherwise be necessary for adequate sealing in the doorway blocking position.

Some roller doors also employ a seal along the sides of the door. Horizontally-disposed roller doors typically employ vertically-extending sideframes which include a channel for receiving and guiding the lateral edges of the curtain. Along most of the length of the sideframe, the channel is narrow enough (relative to the thickness of the curtain) that air or light leakage around the sides of the curtain is not significant. The sideframes are open at the end adjacent the curtain (the top for vertically-disposed sideframes), however, to allow the leading edge of the winding curtain to leave the sideframe as the curtain rolls onto the roller. Further, the channel associated with many sideframes widens out to form a taper to guide the leading edge of the curtain back into the sideframe as it unwinds from the roller. This sideframe structure thus creates a space near the top of the sideframe through which leakage may occur.

Sideframe seals may be employed to prevent such leakage. Typically, however, the sideframe seals also rely on constant friction between a sealing member and the curtain to perform the sealing function. Sealing members in the form of rubber or brushes may be attached near the open upper end of the sideframe to maintain frictional contact with the curtain. Such friction may lead to undue wear on the sealing members and curtain, and may present undesired drag to movement of the curtain.

SUMMARY OF THE INVENTION

It is thus a general aim of the invention to provide an improved sealing system for use in combination with roller doors.

In accordance with that aim, it is a primary object of the invention to provide a roller door sealing system that does not rely on constant frictional engagement with the roller door curtain.

A related object is to provide a roller door sealing system that is not subject to undue wear.

A further related object is to provide a roller door sealing system that will not cause unwanted frictional drag on the door.

A still further related object is to provide a roller door sealing system that will not cause obscuring of an associated vision panel.

Another object of the invention is to provide a roller door sealing system that allows for free travel of the door.

Another object of the invention is to provide a roller door sealing system that is easy to implement, and capable of easy adjustment.

Other objects and advantages of the invention will become apparent from the description to follow.

In accordance with these and other objects, there is provided a roller door sealing system which, in its broadest sense, simply comprises at least one sealing member carried on the curtain, and disposed adjacent the end of the curtain attached to the roller. A seal engaging member is supported adjacent the curtain. The sealing member and the seal engaging member are disposed such that the sealing member engages the seal engaging member and seals the space between the curtain and the seal engaging member as the curtain approaches the doorway-blocking position. As a result, the sealing function provided by the sealing member or members only occurs as the door approaches the door blocking position. In this way, a tight seal is formed to prevent leakage between the door and the seal engaging member, but the seal does not impede normal door operation. Since the seal engaging member is preferably mountable to the wall surrounding to doorway, leakage of air or light past the door is prevented. Further, since the sealing system avoids constant frictional engagement between sealing members and the curtain, undue wear and frictional drag are also avoided.

A first embodiment of the roller door sealing system is a roller seal that seals the space between the roller itself and the wall in which the doorway is formed. This roller seal includes a seal engaging member which is fixed adjacent to the roller. The seal engaging member is illustratively fixed in this position either by attachment to the wall itself, or attachment to existing framing associated with the door. The seal engaging member extends in a direction parallel to the axis of the roller. The seal engaging member is disposed such that it is spaced from the curtain when the curtain is wound on the roller in the unblocking position. Accordingly, the seal engaging member does not contact nor impede the progress of the curtain as it unwinds from the roller. This embodiment of the roller door sealing system also includes a sealing member which extends along the curtain in a direction parallel to the axis of the roller. The sealing member illustratively includes a first flap secured at least along a portion of its length to the curtain. It also includes a second flap that is movable relative to the first flap, and that is movable relative to the curtain. The sealing member is disposed adjacent to the end of the curtain which is attached to the roller. By virtue of the structure of the sealing member, and its position on the curtain, it moves outwardly from the curtain to engage the seal engaging member as the door unwinds from the roller and approaches the doorway blocking position. A centrifugal action thus causes the second flap to separate from the curtain and extend away from the curtain to engage the seal engaging member and seal the space between that member and the curtain. With the roller in a horizontal orientation, the centrifugal action causing the second flap to separate from the curtain may advantageously be assisted by gravity.

In a second embodiment of the roller door sealing assembly, a sideframe seal is provided. The sideframe seal is designed to seal the opening in the sideframe channel at the end of the sideframe adjacent the roller. The sideframe itself is thus the seal engaging member in this embodiment. According to the invention, the sideframe seal is adapted to perform a sealing function only when the door approaches the blocking position. Toward that end, the sideframe seal includes a sealing member in the form of a compressible member, preferably a fabric covered foam pad, secured to the curtain adjacent a side edge of the curtain and extending along the curtain in a direction perpendicular to the roller axis. The compressible member is tapered such that its trailing end projects further away from the curtain that its leading end. The compressible member is disposed adjacent the end of the curtain attached to the roller so that the tapered member engages the opening in the sideframe as the door approaches the blocking position to seal the sideframe opening against air and/or light leakage.

The embodiments of the invention will be described in reference to the appended drawings, wherein:

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents as are included within the spirit and scope of the invention as defined by the appended claims.

The roller door sealing system according to the invention prevents leakage of air and/or light in the vicinity of the roller—either around the roller, out the end of a sideframe disposed adjacent the roller, or both. According to the invention, the sealing member that performs the advantageous sealing function is attached to the door curtain adjacent the end of the curtain attached to the roller, and is thus wound with the curtain on the roller. Accordingly, the sealing member does not perform a sealing function during most of the range of travel of the door. This prevents wear of the seal and the door, and prevents undue drag on the door. As the door approaches the door-blocking position, however, the sealing member is exposed and introduced into the area to be sealed, wherein the sealing member engages a seal engaging member located adjacent the door to seal the space between the seal engaging member and the curtain.

Figure 1:
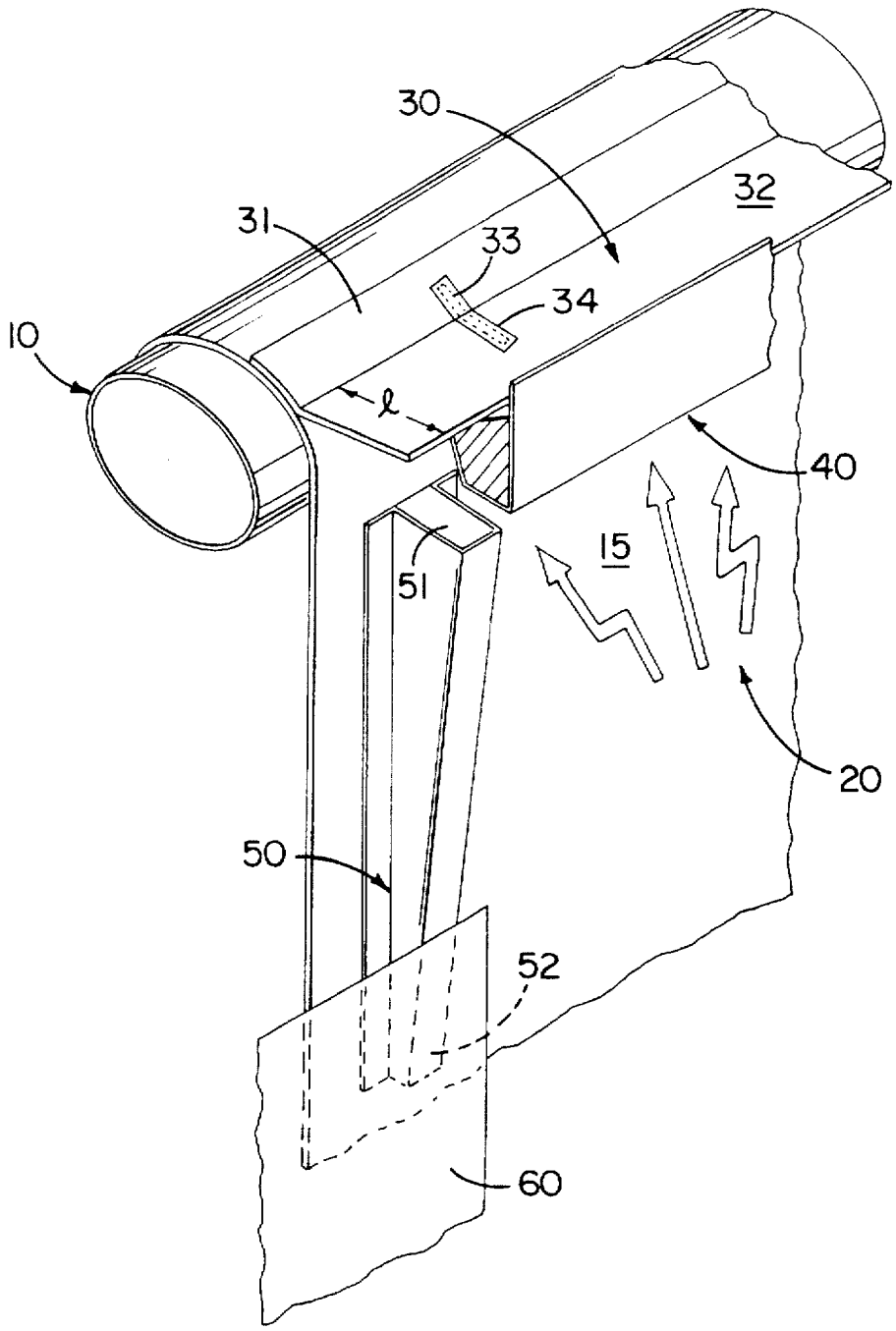
FIG. 1 is a perspective view of a roller door sealing system according to a preferred embodiment of the invention.

A perspective view of a roller door including a sealing system according to the invention is shown in FIG. 1. As will be described in greater detail below, the sealing system in FIG. 1 includes both a roller seal as well as a sideframe seal. The roller door with which the sealing system is associated includes a roller 10 and a fabric curtain 20. The curtain 20 has one end attached to the roller 10, and is windable and unwindable therefrom. The roller door is associated with a doorway or other opening (not shown in FIG. 1) in the wall of a warehouse, manufacturing facility, or other building or enclosure. With the curtain 10 wound on the roller 20, personnel and equipment can freely pass through the doorway with which the door is associated. However, as the curtain 20 is unwound from the roller, it will assume a doorway blocking position in which the curtain extends over the doorway, and in which passage through the doorway is obstructed or prevented. As will be appreciated by one of skill in the art, a variety of means may be employed to wind the curtain onto and off of the roller, including powered means, manual means and gravity. Further, the "curtain" may be formed from a variety of materials including fabrics.

To prevent leakage of air or light past the roller door in the vicinity of the roller 10 (such as that represented by the open arrows 15 in FIG. 1), one or more sealing systems according to the invention may be provided. FIG. 1 shows two representative embodiments of such sealing systems. The first such sealing system is a roller seal which includes a roller sealing member 30 and a roller seal engaging member 40. The second such sealing system is a sideframe seal which includes a sideframe sealing member 50, and a sideframe seal engaging member 60. In both embodiments, and as will be discussed in greater detail below, the respective sealing members are disposed adjacent to the end of the curtain 20 that is attached to the roller 10, and the seal engaging members are disposed adjacent the curtain 20. With the curtain 20 wound on the roller 10, the seal engaging members 40 and 60 are spaced from the curtain. As the curtain 20 approaches the doorway blocking position, the respective sealing members 30 and 50 engage their respective seal engaging members 40 and 60 to seal the space between the curtain and each seal engaging member.

In the roller seal embodiment of the invention, the roller seal engaging member 40 is supported adjacent the curtain 20 by being fixed to a header member 80, which is itself fixed adjacent to the wall W in which the doorway D is disposed. The header member 80 extends between and is preferably mounted to the sideframes, such as by bolts 82. The header member 80 is seen most clearly in the partial section view of FIG. 3. The header member 80 is illustratively a box beam fixed adjacent to the wall W. The roller seal engaging member 40 is, in turn, fixed to the header member 80 by bolts 99. In the alternative, the roller seal engaging member 40 could be supported adjacent the curtain by attachment directly to the wall W, or to other structure. In the present embodiment, the seal engaging member 40 comprises a foam pad having an illustratively tetragonal cross-section, including an upper surface 41 forming an angle 42 with the horizontal. At present, the preferred angle 42 for the surface 41 is 45°.

Preferably, the foam pad is covered with a wear-resistant fabric such as 16 oz. HYPALON brand fabric. The pad 40 extends in a direction parallel to the axis of the roller (see FIG. 1) for substantially the entire width of the roller. Although a pad has been shown as a representative example of the seal engaging member 40, the invention is not so limited. Rather, a variety of seal engaging members could be used. For example, the seal engaging member could be formed entirely of fabric, or could be a section of metal or wood framing associated with the roller door, or mounted directly to the wall in which the doorway is formed. Alternatively, it could be a section of the wall itself. For the purpose of the invention, the seal engaging member 40 need only be disposed adjacent to the curtain 20, and be engageable by the sealing member 30 to seal the space between the curtain and the seal engaging member 40.

The roller sealing member 30 also extends across the width of the curtain in a direction parallel to the axis of the roller. Referring to FIG. 1, it can be seen that the roller sealing member 30 includes a first flap 31 which is secured along at least a portion of its length to the curtain. At present, it is preferred to secure the first flap 31 to the curtain 20 by means of a hook and loop fastener, such as that sold under the brand name VELCRO. Alternatively, the flap 31 could be stitched to the curtain 20. The roller sealing member 30 also includes a second flap 32 that is not secured to the curtain 20, and that is thus movable relative to both the curtain 20 and the first flap 31.

According to the invention, the roller sealing member 30 is disposed adjacent the end of the curtain 20 that is attached to the roller so that the sealing member 30 is simply wound up with the curtain 20 on the roller 10 during most of the range of travel of the roller door. The structure of the sealing member 30 is such, however, that the second flap 32 is disposed to move outwardly from the curtain 20 to engage the roller seal engaging member 40 as the curtain 20 approaches the doorway blocking position. The movement of the second flap 32 according to this embodiment of the invention is seen in phantom in FIG. 3. As the curtain 20 unrolls so as the expose the second flap 32 (position "A" in FIG. 3), the flap 32 moves away from the curtain 20 due to a centrifugal force generated by rotation of the roller 10. This movement is also due to gravity working on the flap 32. As the roller continues to roll, the flap 32 moves with it to the "B" position. The material forming flap 32 is of sufficient stiffness to maintain the flap 32 in a flat configuration. As presently preferred, both the curtain and the sealing member 30 are formed of 38 oz. HYPALON brand fabric. As the flap 32 moves through position "C" of FIG. 3, it moves to a position where it engages the top surface 42 of the roller seal engaging member 40, thus sealing the space between the curtain 20 and the seal engaging member 40 against air leakage. According to a significant aspect of the invention, the position of the sealing member 30 along the curtain 20 is such that this engagement occurs as the curtain 20 assumes its doorway blocking position. The preferably 45° angle of surface 41 is such that the flap 32 will maintain frictional contact therewith to maintain the seal.

As will be appreciated by one of skill in the art, the roller 10 must be rotating at a certain speed in order for the second flap 32 of the sealing member 30 to initially move away from the curtain and stay separated from the curtain for the purpose of engaging the seal engaging member 40. This speed may depend on a variety of factors including the diameter of the roller, the length of the flap 32 (designated "I" in FIG. 1), the stiffness of the material forming the flap 32, and whether the movement of the flap away from the curtain is assisted by gravity, as in the configuration of FIGS. 1–3. We have found that for a horizontally disposed roller having a diameter of 5 inches, and a flap 32 of length 5¾" formed of 38 oz. HYPALON, that a roller speed of 120 rpm will properly actuate the seal 30 to engage the seal engaging member 40. Both higher and lower speeds may also properly actuate the sealing member 30, depending on the factors listed above. The actuation of the flap 32 may also be assisted by the addition of stiffeners 33, such as the one illustratively shown in FIG. 1 and received within a pocket 34 in the roller seal 30.

Figure 3:
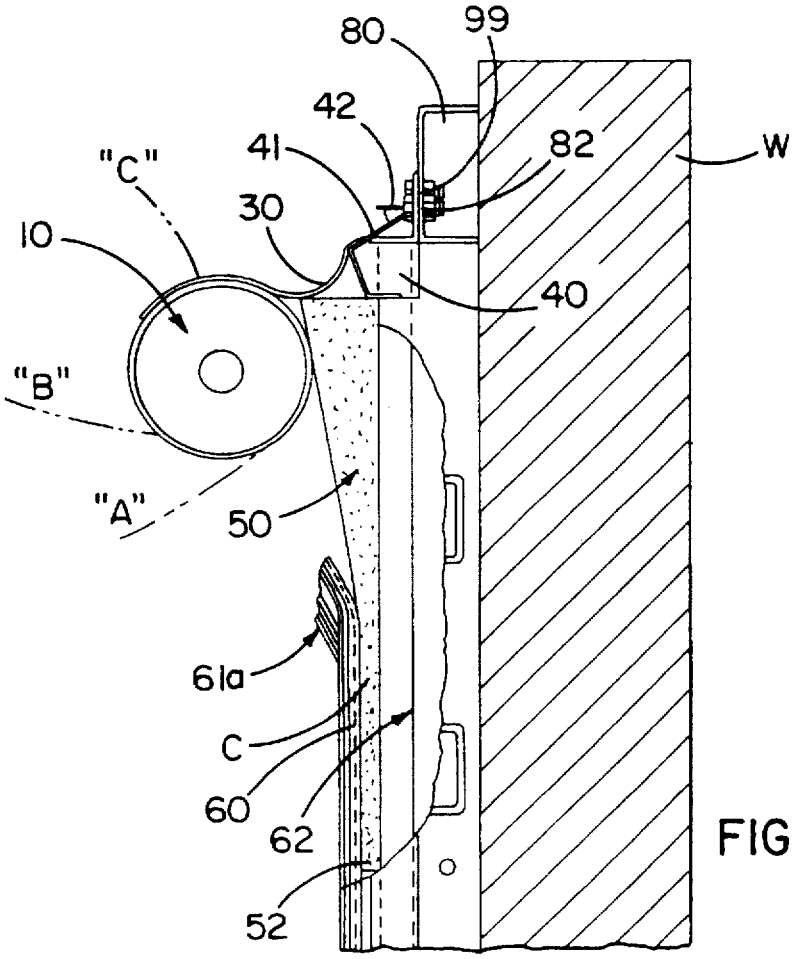
FIG. 3 is a partial section view of the roller door sealing system of FIG. 2.
Figure 4:
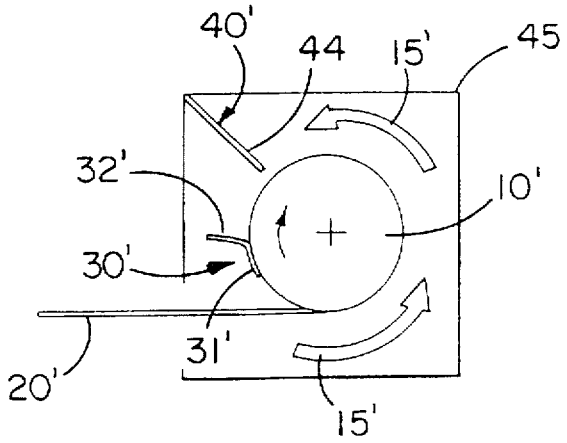
FIG. 4 is a top section view of an alternative embodiment of a roller door sealing system according to the invention.
Figure 5:
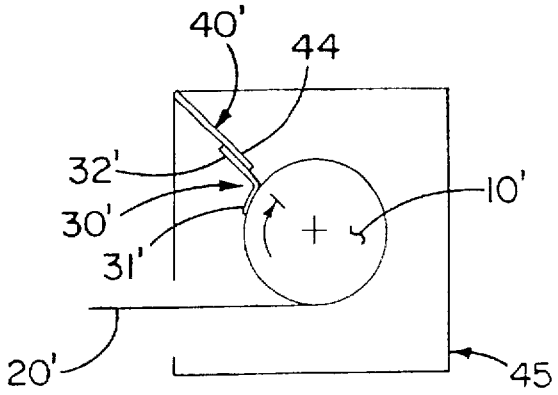
Fig 5 is a top section view of the alternative embodiment of FIG. 4, in the sealing position

A roller seal in an alternative embodiment of the invention is shown in FIGS. 4 and 5. This embodiment is largely the same as that of FIGS. 1–3 with the exception that the roller is vertically-disposed (FIGS. 4 and 5 are thus a top plan view of this embodiment). Accordingly, the same reference numerals as in FIGS. 1–3, but including a prime, will be used for referring to components in FIGS. 4–5. The roller seal system again includes a roller sealing member 30', illustratively including a first flap 31' secured to the curtain 20' and a second flap 32' that is movable relative to the curtain 20'. The roller sealing member 30' extends along the curtain 20' in a direction parallel to the axis of the roller 10' (into the page in the sense of FIG. 4). The roller sealing member 30' is disposed along the curtain adjacent the end attached to the roller 10'. A seal engaging member 40' is disposed adjacent the curtain 20'. In this embodiment, the seal engaging member 40' is illustratively a metal angle 44 fixed to a frame 45 surrounding roller 10', and it also extends in a direction parallel to the axis of the roller 10'.

Because of the position of the roller sealing member 30' along the curtain 20', and according to the invention, the sealing member 30' is rolled up with the curtain during most of the range of travel of the door. As the curtain 20' is unwound form the roller 10' and approaches the doorway-blocking position, however, the sealing member 30' is exposed and introduced into the area to be sealed. Because of the rotation of the roller 10', the second flap 32' moves outwardly from the curtain 20', as shown in FIG. 4. Continued rotation of the roller 10' moves the second flap 32' such that it engages the seal engaging member 40', thus sealing the space between the curtain 20' and the seal engaging member 40' from the leakage of air, such as that depicted by open arrows 15' in FIG. 5.

Returning to FIGS. 1–3, a further alternative embodiment of the invention is also shown. This alternative embodiment, in the form of a sideframe seal, is similar to the prior embodiments in that it includes a sealing member carried on the curtain, and disposed adjacent the end of the curtain attached to the roller. It also includes a seal engaging member supported adjacent the curtain. The sealing member and the seal engaging member are disposed such that the sealing member engages the seal engaging member and seals the space between the curtain and the seal engaging member as the curtain approaches the doorway-blocking position.

The sideframe sealing member of this embodiment is in the form of a compressible member 50, shown in perspective in FIG. 1. The compressible member 50 is generally rectangular in cross-section and extends along the curtain in a direction perpendicular to the axis of the roller 10. The member 50 is also tapered from a trailing end 51 to a leading end 52 such that the trailing end 51 has a greater projection away from the curtain 20 than the leading end 51. Compressible member 50 is preferably comprised of a compressible foam pad encased in fabric such as CORDURA brand nylon fabric. The fabric covering the foam pad of compressible member 50 is preferably secured to the curtain by a hook and loop fastener such as VELCRO brand fastener. Alternatively, the fabric could be sewn to the curtain 20. As will be appreciated, the compressible member need not be formed of a foam pad, nor does it need to be encased in fabric. On the contrary, any compressible material that will return to its original shape after the compressive force is removed would be acceptable for use according to this embodiment of the invention.

Figure 2:
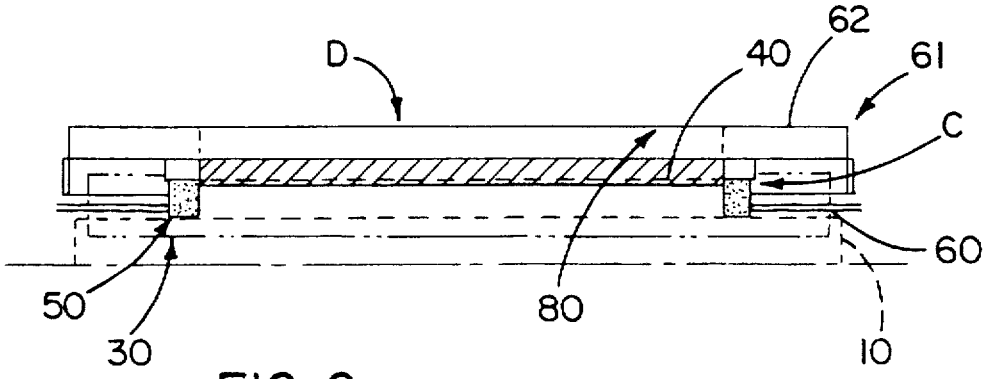
FIG. 2 is a top view of the roller door sealing system of FIG. 1.

The seal engaging member of this embodiment is a front panel 60 of a sideframe 61 typically associated with roller doors. Such sideframes 61, seen most clearly in the plan view of FIG. 2, provide structural support for the roller door and, in many instances, also provide a channel C along the side edge of the door within which the lateral edges of the curtain 20 are received. The sideframes 61 thus help prevent leakage of air and/or light around the side edges of the door. Structural members, such as windstraps, which are attached to the curtain may also be received within the channel C to help prevent the curtain from billowing under conditions wherein opposite sides of the door are subjected to wind or different pressures. The sideframe 61 of the present embodiment includes the front panel 60 which cooperates with the rear portion 62 to form the channel C. As best seen in FIG. 3, the front panel 60 includes a flaring portion 61 a at the end adjacent the roller 10. The purpose of this flare is to allow the leading edge of the curtain 20 to be guided into the channel C as the curtain goes from the fully wound toward the doorway-blocking position. The presence of such a flare, however, could allow leakage out the top of the sideframe.

The engagement between the front panel 60 and the sideframe sealing member 50, however, prevents such leakage. As the curtain 20 approaches the doorway-blocking position, the leading end 52 of the compressible member 50 engages the front panel 60 of the sideframe 61. Since the compressible member is wedge-shaped, further advance of the curtain causes increasingly thicker portions of the compressible member 50 to engage the panel 60, thus causing the member 50 to compress. When the curtain is fully extended to the doorway blocking position, the compressible member 50 is thus compressed by the front panel 60 and the compressible member 50 fills the channel C to seal the space between the front panel 60 and the curtain 20. As will be apparent to one of skill in the art, such sideframe seals are preferably used on each lateral edge of the door to seal both sides. Further, although the sideframe seal has been shown in use on a roller door including a horizontally-disposed roller, a similar seal could be used on a vertically disposed roller.

There has thus been disclosed a sealing system for a roller door in which a sealing member is disposed adjacent to the end of the curtain attached to the roller, such that the sealing member engages a seal engaging member disposed adjacent the roller as the curtain approaches a doorway blocking position. As a result of this structure, an effective seal against leakage in the vicinity of the roller is provided without a constant contact between a seal member and the curtain, which constant contact adds drag to the door and leads to wear of the seal and the curtain. Both a roller seal, extending across the width of the roller, and a sideframe seal, sealing an opening in the sideframe adjacent the roller, are provided.

What is claimed is:

1. A sealing system in combination with a roller door, the roller door adapted to be disposed adjacent a doorway and including a curtain with a first end and a second end, the first end being attached to a roller, the roller including an axis, such that the curtain is windable onto and unwindable from the roller for selective movement between an unblocking and a doorway-blocking position; the sealing system comprising: a sealing member mounted on the curtain for movement therewith between the unblocking and doorway-blocking positions and including a first flap secured along at least a portion of its length to the curtain, the sealing member including a second flap that is movable relative to the curtain, the sealing member being disposed adjacent to the first end and disposed such that the second flap moves outwardly from the curtain to engage the seal engaging member as the curtain approaches the doorway-blocking position; a seal engaging member adapted to be fixed adjacent to the doorway and to the curtain, the seal engaging member being spaced from the sealing member when the curtain is wound on the roller and being disposed such that the second flap of the sealing member engages the seal engaging member and seals the space between the curtain and the seal engaging member as the curtain approaches the doorway-blocking position.

2. The combination of claim 1 wherein the sealing member is a roller sealing member extending along the curtain in a direction parallel to the axis of the roller, and wherein the seal engaging member extends in a direction parallel to the axis of the roller.

3. The combination of claim 1, wherein the first flap of the sealing member is secured to the curtain by hook and loop fastener.

4. The combination of claim 1 wherein the seal engaging member comprises a foam pad attached to a wall adjacent the doorway.

5. The combination of claim 1 wherein the roller is horizontally disposed.

6. The combination of claim 1 wherein the roller is vertically disposed and received within a frame.

7. The combination of claim 6, wherein the seal engaging member is an angle member attached to the frame.

8. A sealing system in combination with a roller door, the roller door adapted to be disposed adjacent a doorway and including a curtain with a first end attached to a roller, the roller including an axis, such that the curtain is windable onto and unwindable from the roller for selective movement between an unblocking and a doorway-blocking position; the sealing system comprising: a sealing member mountable on the curtain and disposed adjacent to the first end of the curtain, the sealing member comprising a compressible member extending along the curtain in a direction perpendicular to the roller axis; a seal engaging member fixable adjacent to the curtain and comprising a panel of a sideframe extending in a direction perpendicular to the roller axis of the door and including a channel for receiving and guiding a lateral edge of the curtain as the curtain unwinds from the roller, the channel having an opening adjacent the roller, the seal engaging member being spaced from the curtain when the curtain is wound on the roller and being disposed such that the sealing member engages the seal engaging member and seals the space between the curtain and the seal engaging member as the curtain approaches the doorway-blocking position, wherein the compressible member includes a leading end and a trailing end, and is tapered to have a greater projection away from the curtain at the leading end, and a lesser projection away from the curtain at the trailing end; the compressible member being disposed along the curtain to engage the sideframe panel as the door approaches the blocking position to seal the sideframe opening adjacent the roller against leakage.

9. The combination of claim 8, wherein the compressible member comprises a wedge-shaped foam pad.

10. The combination of claim 8, wherein the compressible member further comprises a fabric covering secured along at least a portion of its length to the curtain.

11. The combination of claim 10, wherein the fabric covering is secured to the curtain by hook and loop fastener.

* * * * *

UNITED STATES PATENT AND TRADEMARK OFFICE

CERTIFICATE OF CORRECTION

PATENT NO. : 5,794,678

DATED : August 18, 1998

INVENTOR(S) : Beringer et al.

It is certified that error appears in the above-identified patent and that said Letters Patent is hereby corrected as shown below:

Claim 1
Col. 8, line 58 after "the curtain to engage...", delete "the" and insert -- a --.

Claim 1
Col. 8, line 60 after "position;...", delete "a" and insert -- the --.

Signed and Sealed this

Nineteenth Day of December, 2000

*Attest:*

Q. TODD DICKINSON

*Attesting Officer*

*Commissioner of Patents and Trademarks*